US005814596A

United States Patent [19]

Aquad et al.

[11] Patent Number: 5,814,596

[45] Date of Patent: Sep. 29, 1998

[54] STRUCTURED DETERGENT PASTES AND A METHOD FOR MANUFACTURING DETERGENT PARTICLES FROM SUCH PASTES

[75] Inventors: Yousef Georges Aquad, Jeddah, Saudi Arabia; Brian Joseph Pangrle, Elk Grove Village, Ill.; Johan Gerwijn L. Pluyter, Strombeek-Bever, Belgium

[73] Assignee: The Procter & Gamble Company, Cincinnati, Ohio

[21] Appl. No.: 750,242

[22] PCT Filed: Jun. 23, 1995

[86] PCT No.: PCT/US95/08794

§ 371 Date: Feb. 24, 1997

§ 102(e) Date: Feb. 24, 1997

[87] PCT Pub. No.: WO96/00279

PCT Pub. Date: Jan. 4, 1996

[30] Foreign Application Priority Data

Jun. 24, 1994 [EP] European Pat. Off. ..... 94201821

[51] Int. Cl.[6] ..... C11D 17/06; C11D 3/37; C11D 3/33

[52] U.S. Cl. ..... 510/444; 510/336; 510/370; 510/373; 510/404; 510/467; 510/477; 510/478; 510/488; 510/489; 510/490; 510/491; 510/492; 510/495; 510/497; 510/498; 510/499; 510/500; 510/504; 510/505; 510/506; 510/507; 510/509; 510/510; 510/535; 510/537

[58] Field of Search ..... 510/404, 535, 510/537, 444, 336, 370, 373, 467, 477, 478, 488, 489, 490, 491, 492, 495, 497, 498, 499, 500, 504, 505, 506, 507, 509, 510, 532, 533, 534

[56] References Cited

U.S. PATENT DOCUMENTS

| | | | |
|---|---|---|---|
| 4,551,506 | 11/1985 | Gosselink | 525/417 |
| 5,066,425 | 11/1991 | Ofosu-Asante et al. | 510/536 |
| 5,152,914 | 10/1992 | Forster et al. | 510/122 |
| 5,254,333 | 10/1993 | Kajino et al. | 424/70 |

FOREIGN PATENT DOCUMENTS

| | | | |
|---|---|---|---|
| 0 080 222 A1 | 11/1982 | European Pat. Off. | C11D 3/37 |
| 0 508 534 A1 | 4/1992 | European Pat. Off. | C11D 17/06 |
| WOA92/01778 | 7/1991 | WIPO | C11D 11/04 |
| WOA94/10282 | 10/1993 | WIPO | C11D 3/37 |

OTHER PUBLICATIONS

Chemical Abstract No. 92:182881 which is an abstract of Japanese Patent Specification No. 54–161607 (Dec. 1979).

Abstract No. 94–156884/19; Granular detergent compsn. having high bulk density and good washability–comprises surfactant(s) alkali metal carbonate, with aluminosilicate salt, polymer and itaconic acid–vinyl pyrrolidone salt as calcium ion arrestors, useful for clothes washing; (Japanese Patent Specification No. JP–06100886) (Apr. 1994).

*Primary Examiner*—Anthony Green
*Attorney, Agent, or Firm*—Ken K. Patel; Kim W. Zerby; Jacobus C. Rasser

[57] ABSTRACT

The present invention provides a structured paste which is substantially free of LAS and which is suitable for processing into a high bulk density, high active granular detergent. Surfactant pastes of the present invention have a viscosity of at least 10 Pa.s (measured at 70° C. and 25 $sec^{-1}$) and comprise: from 30% to 90% by weight of anionic surfactant; from 0% to 50% by weight of nonionic surfactant; from 0.5% to 20% by weight of either a polymeric cationic material or a polar amino acid; and from 1% to 40% by weight of water.

20 Claims, No Drawings

STRUCTURED DETERGENT PASTES AND A METHOD FOR MANUFACTURING DETERGENT PARTICLES FROM SUCH PASTES

The present invention relates to structured surfactant pastes, and to processes for making a high bulk density detergent component by forming a structured surfactant paste, and subsequently granulating the paste to form free-flowing particles having a bulk density of at least 650 g/l.

In recent years there has been a trend towards making granular detergents having a higher bulk density than before. Various techniques of making dense granular detergents, and of processing low density granular detergents in such a way that the bulk density is increased, have been described. One example of a suitable techniques for making dense granular detergents is known as "agglomeration". This term describes any process in which small particles of the components are processed in such a way that they are built-up (or "agglomerated") to form suitable granular components.

The ideal detergent agglomerate should have a high bulk density and a high surfactant content and yet still have good solubility and dispersion properties. It should also be possible to use a manufacturing process which is both efficient and versatile.

The general use of quaternary ammonium compounds as cationic surfactants as components of surfactant agglomerates is disclosed in patent application, EP510746, published on Oct. 28th, 1992. However the cationic surfactants described generally have a low structuring effect, if indeed they have any structuring effect at all.

EP508543 also published on Oct. 28th, 1992 discloses various means for structuring a surfactant paste. It is disclosed that anionic surfactant pastes are preferably structured (i.e. physically/chemically brought into a specific crystalline phase having a high viscosity) prior to high active paste agglomeration. Such a structuring or "conditioning" step enables granulation of the paste to be carried out resulting in very high active surfactant particles. The conditioning step minimises or eliminates problems such as caking and poor rate of solubility. However whilst the conditioning steps described are particularly effective with certain compositions of surfactant pastes, they are less effective with other surfactant compositions.

It is an objective of the present invention to provide structured pastes which are highly suitable for subsequent granulation.

This has been achieved by incorporating polymeric cationic compounds, or polar amino acids into surfactant pastes.

Polymeric cationic compounds are known as components of compositions for textile conditioning and hair conditioning. Typical disclosures are U.S. Pat. No. 4,179,382 and U.S. Pat. No. 5,116,543 which are discussed below. However in neither of these applications is a high active (greater than 35% active by weight) anionic surfactant paste disclosed which is effectively structured by the polymeric cationic compound.

U.S. Pat. No. 4,179,382, published on Dec. 18th, 1979, discloses textile conditioning compositions containing polymeric cationic materials. In addition to the polymeric cationic material, the compositions comprise cationic surfactant and optionally nonionic surfactant. There is no mention of anionic surfactants.

Many compositions of the prior art disclose polymeric cationic materials as active hair conditioning agents. One such example is:

U.S. Pat. No. 5,116,543, published on May 26th, 1992 describes a paste comprising an anionic surfactant, a skin conditioner, a hair conditioner (polymeric cationic material) and a preservative. The paste is for bathing with a small quantity of water in microgravity conditions. Preferred pastes are very viscous and comprise from 15–25% of anionic surfactant and 0.1–3% of polymeric cationic material.

In particular, the present invention offers a method of structuring pastes which have a low amount (or zero) of linear alkyl benzene sulphonate (LAS). LAS has previously been a common surfactant in laundry detergents and methods of effectively structuring LAS have been discussed in the prior art (mentioned above). Now there is a tendency to reduce the level of LAS in favour of other anionic surfactants. Consequently the present invention provides a structured paste which is substantially free of LAS and which is suitable for processing into a high bulk density, high active granular detergent.

SUMMARY OF THE INVENTION

Surfactant pastes of the present invention have a viscosity of at least 10 Pa.s (measured at 70° C. and 25 $sec^{-1}$) and comprise:

from 30% to 90% by weight of anionic surfactant;

from 0% to 50% by weight of nonionic surfactant;

from 0.5% to 20% by weight of either a polymeric cationic material or a polar amino acid; and from 1% to 40% by weight of water.

The polymeric cationic material where present is preferably at a level of from 1% to 12% by weight.

The polymeric cationic material preferably has a molecular weight of from 5,000 to 100,000,000, preferably 10,000 to 10,000,000, and most preferably 1,000,000 to 10,000,000. The average number of cationic functional groups per molecule of polymer is preferably at least 2, and more preferably from 10 to 1,000,000.

The cationic functional groups may be selected from the group consisting of carboxylate, amide, pyrrolidone, imidazole, imidazolinium and mixtures thereof.

The polar amino acid where present is preferably at a level of from 1% to 12% by weight. The polar amino acid preferably being selected from the group consisting of lysine di-hydrochloride, L-arginine hydrochloride, and mixtures thereof.

The polar amino acid preferably has a molecular weight of from 5,000 to 100,000,000, preferably 10,000 to 10,000,000, and most preferably 1,000,000 to 10,000,000. The polar amino acid preferably has at least 2 functional groups selected from the group consisting of amine, quaternary amine and mixtures thereof.

It is further preferred that the surfactant paste includes a total level of alkyl benzene sulphonate surfactant which is less than 5%, preferably less than 2% by weight of the paste.

A further embodiment of the invention is a granular detergent composition or component having a bulk density of at least 650 g/l, comprising:

(a) from 35% to 70% by weight of surfactant; and (b) from 0.1% to 20% by weight of either a polymeric cationic material or a polar amino acid (preferably chosen from those polymeric cationic materials and/or polar amino acids described above).

DETAILED DESCRIPTION OF THE INVENTION

Structuring of a paste means the modifying its physical characteristics. This may be done in order to form higher active agglomerates which otherwise are not easily obtainable under normal operating conditions. The present invention is particularly applicable to all neutralized aqueous alkyl sulphate pastes. In one embodiment of the present invention, the anionic surfactant is formed into an aqueous, highly concentrated solution of its salt, preferably its sodium salt. These high active (and, preferably, low moisture) surfactant pastes are of a high viscosity but remain pumpable at temperatures at which the surfactants are stable. In the present invention cationic polymers and/or polar amino acids that alter the physical structure and/or physical characteristics of the surfactant paste are added to the paste. It has been found that the addition to the surfactant paste reduces the stickiness of the paste, increases its viscosity and increases its softening point. This allows for more paste to be added during the agglomeration process thus leading to higher active agglomerates i.e. more than 35%, preferably more than 50%. This method of structuring (or "conditioning") the surfactant paste can be performed batchwise and continuously, preferably continuously.

Structuring of the paste, as defined herein, means: a) increasing hardness, b) reducing stickiness and c) increasing elasticity, The hardness and stickiness of the paste can be measured using a Texture Analyer/Penetrometer (e.g. Stevens Texture analyser QTS25). If the paste hardness measured by this technique increases by at least 50%, preferably 100%, more preferably 200%; and the stickiness of the paste, as measured by the same instument decreases by 20%, preferably 40%, more preferably 60%, then the paste is considered to have been structured within the meaning of the present invention.

A preferred paste useful for this invention consists of at least 40% by weight of salts of anionic surfactants, which has a viscosity of at least 10 Pa.s when measured at 70° C. and a shear rate of 25 $s^{-1}$.

The Polymeric Cationic and Polar Amino Acid Structuring Agents

In general terms polymeric cationic structuring agents useful in the present invention are

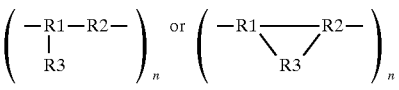

where n represents a number of basic units which are combined as either homopolymers or copolymers. n is preferably from 10 to 1,000,000, preferably from 100 to 10,000.

R1 is aliphatic, aromatic or saccharide unit, R2 is ester, ketone, amine units or a C—C linkage, and R3 is a cationic functional group which is connected to the backbone of the polymer by means of a C1 to C10 alkyl or alkylene chain. The cationic functional group of R3 is selected from the group consisting of carboxylate, amide, pyrrolidone, imidazole and imidazolinium. In the case of co-polymers some of the R3 units may be anionic or nonionic functional groups.

Specific examples of suitable polymeric cationics are given in U.S. Pat. No. 4,179,382. Most preferred for use in the present invention are polyquaternium-6, polyquaternium-28, such as those sold under the Trade Name Merquat® and Gafquat®.

Other structuring agents are polar amino acids having at least 2 functional groups selected from the group consisting of amine, quaternary amine and mixtures thereof. Particularly preferred polar amino acids are lysine di-hydrochloride, L-arginine hydrochloride, and mixtures thereof.

The Pastes

One or various aqueous pastes of the salts of anionic surfactants is preferred for use in the present invention, preferably the sodium salt of the anionic surfactant. In a preferred embodiment, the anionic surfactant is preferably as concentrated as possible, (that is, with the lowest possible moisture content that allows it to flow in the manner of a liquid) so that it can be pumped at temperatures at which it remains stable. While granulation using various pure or mixed surfactants is known, for the present invention to be of practical use in industry and to result in particles of adequate physical properties to be incorporated into granular detergents, an anionic surfactant must be part of the paste in a concentration of above 30%, preferably from 30–95%, more preferably from 40–95%, and most preferably from 50%–95%.

It is preferred that the moisture in the surfactant aqueous paste is as low as possible, while maintaining paste fluidity, since low moisture leads to a higher concentration of the surfactant in the finished particle. Preferably the paste contains between 1% and 40% water, more preferably between 5 and 30% water and most preferably between 5% and 20% water.

It is preferable to use high active surfactant pastes to minimize the total water level in the system during mixing, granulating and drying. Lower water levels allow for: (1) a higher active surfactant to builder ratio, e.g., 1:1 and above; (2) higher levels of other liquids in the formula without causing dough or granular stickiness; (3) less cooling, due to higher allowable granulation temperatures; and (4) less granular drying to meet final moisture limits.

Two important parameters of the surfactant pastes which can affect the mixing and granulation step are the paste temperature and viscosity. Viscosity is a function, among others, of concentration and temperature, with a range in this application from about 10 Pa.s to 10,000 Pa.s. Preferably, the viscosity of the conditioned paste is from about 20 to about 100 Pa.s and more preferably from about 30 to about 70 Pa.s. The viscosity of the paste of this invention is measured at a temperature of 70° C. and a shear rate of 25 $s^{-1}$.

The paste can be introduced into the mixer (or the first of a series of mixers) at an initial temperature between its softening point (generally in the range of 40°–60° C.) and its degradation point (depending on the chemical nature of the paste, e.g. alkyl sulphate pastes tend to degrade above 75°–85° C.). High temperatures reduce viscosity simplifying the pumping of the paste but result in lower active agglomerates. In the present invention, the activity of the agglomerates is maintained high due to the elimination of moisture.

High Active Surfactant Paste

The aqueous surfactant paste contains an organic surfactant selected from the group consisting of anionic, nonionic, zwitterionic, ampholytic and cationic surfactants, and mixtures thereof. Anionic surfactants are preferred. Surfactants useful herein are listed in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. No. 4,239,659, Murphy, issued Dec. 16, 1980.

The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used.

Water-soluble nonionic surfactants are also useful as surfactants in the compositions of the invention. Indeed, preferred processes use anionic/nonionic blends. A particularly preferred paste comprises a blend of nonionic and anionic surfactants having a ratio of from about 0.01:1 to about 3:1, more preferably about 0.1:1 to 1:1. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 0.8 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per mole of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Particularly preferred surfactants herein include coconut and tallow alkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of C9–C15 alcohols with from about 3 to 8 moles of ethylene oxide, and mixtures thereof.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and R7 are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

The ratio of the surfactant active to dry detergent builder or powder ranges from 0.1 to 19:1, preferably from 1:1 to 10:1, and more preferably from 1.5:1 to 5:1.

Processing and Processing Equipment

In a preferred embodiment of the invention an extruder is used to structure or "condition" the paste. The extruder is a versatile piece of equipment which enables two or more pastes to be mixed and/or the chemical structuring agents to be added to, and mixed with the viscous paste. Furthermore it enables moisture to be removed under vacuum, and it enables control of paste temperature.

In an alternative embodiment of the invention a Discotherm® is used to structure the paste. The Discotherm®, like the extruder, enables two or more pastes to be mixed and/or the chemical structuring agents to be added to, and mixed with the viscous paste, and it enables moisture to be removed under vacuum. It is possible to dry the paste in the Discotherm® to low levels of moisture, and to directly form the surfactant contaning particles in that piece of equipment which can be directly mixed with other granular components to form the finished product.

Also useful in the present invention is a thin film evaporator. However this piece of eqipment may not be suitable for handling the high viscosity materials which are preferred in the present invention, because high viscosity materials do not easily form a thin film.

Moreover the thin film evaporator does not allow intimate mixing, and simultaneously structuring and drying.

The high active surfactant paste of the present invention may, after the structuring step, be granulated in further processing steps. Alternatively if the granulation of the high active paste has already been started simultaneously with the structuring step, then further processing steps may be used to complete granulation. Granulation may be carried out in a mixer.

Especially preferred are mixers of the Fukae$^R$ FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention inlcude Diosna$^R$ V series ex Dierks & Söhne, Germany; and the Pharma Matrix$^R$ ex T K Fielder Ltd., England. Other mixers believed to be suitable for use in the process of the invention are the Fuji$^R$ VG-C series ex Fuji Sangyo Co., Japan; and the Roto$^R$ ex Zanchetta & Co srl, Italy.

Other preferred suitable equipment can include Eirich$^R$, series RV, manufactured by Gustau Eirich Hardheim, Germany; Lödige$^R$, series CB and KM in series for continuous mixing/agglomeration, manufactured by Lödige Machinenbau GmbH, Paderborn Germany; Drais$^R$ T160 series, manufactured by Drais Werke GmbH, Mannheim Germany; and Winkworth$^R$ RT 25 series, manufactured by Winkworth Machinery Ltd., Bershire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

The granules may be subjected to a further drying step if the moisture level is to be further reduced. A conventional fluidised bed dryer is suitable for this.

Processing Conditions

Preferred operating temperatures for paste structuring and granulation should also be as low as possible since this leads to a higher surfactant concentration in the finished particle. Preferably the temperature during the agglomeration is less than 100° C., more preferably between 40° and 90° C., and most preferably between 60° and 80° C.

EXAMPLES

Example 1

| Structured Paste: | Parts by weight: |
|---|---|
| a. Sodium Alkyl Sulphate | 40 |
| b. Polyquaternium-6 | 1 |
| c. Water and miscellaneous | 15 |
| | 56 |
| d. Sodium aluminosilicate (anh.) | 20 |
| e. Water (bound to aluminosilicate) | 4 |
| f. Sodium carbonate | 24 |
| | 104 |

a = Sodium alkyl sulphate having an average carbon chain length of C12 to C15
b = Merquat ®
d = Zeolite 4A
f = finely divided; having a mean particle size of 114 micrometers A structured paste was prepared by mixing a high active sodium alkyl sulphate paste (the paste comprising 20% by weight of water and not more than 4% by weight of impurities, typically sulphate and unreacted alcohol), with a 40% aqueous solution of Merquat®. The mixing was carried out in a lab scale mixer at 60° C. for 10 minutes. The hardness of the paste during the structuring step inreased by 200%.

A dry blend of zeolite and carbonate was then added to a high shear mixer (a food processor) to give the finished composition. Upon addition of the zeolite/carbonate mix, discrete granules were formed having a mean particle size of 500 micrometers (95% by weight of the particles having a particle size of between 300 and 800 micrometers).

The particles were subsequently dried in a fluidised bed for 10 minutes in air at 60° C. to attain a free moisture level of 4%, and a surfactant activity of 40% by weight.

Example 2

| Structured Paste: | Parts by weight: |
|---|---|
| a. Sodium Alkyl Sulphate | 40 |
| b. Polyquaternium-28 | 2 |
| c. Water and miscellaneous | 20 |
| | 62 |
| d. Sodium aluminosilicate (anh.) | 17 |
| e. Water (bound to aluminosilicate) | 4 |
| f. Sodium carbonate | 22 |
| | 105 |

b = Gafquat ®

A structured paste was prepared by mixing a high active sodium alkyl sulphate paste (the paste comprising 20% by weight of water and not more than 4% by weight of impurities, typically sulphate and unreacted alcohol), with a 22% aqueous solution of Gafquat®. The mixing was carried out in a twin screw extruder at a rate of 100 kg/h. Mixing of the paste and structuring agent takes place continuously at the kneading block of the extruder. The structured paste exits the extruder at 50° C.

A sample of the paste was then granulated in lab scale high shear mixer with a dry blend of zeolite and carbonate as in example 1.

The particles were subsequently dried in a fluidised bed for 10 minutes in air at 60° C. to attain a free moisture level of 4%, and a surfactant activity of 40% by weight.

Example 3

| Structured Paste: | Parts by weight: |
|---|---|
| a. Sodium Alkyl Sulphate | 60 |
| b. Polyquaternium-6 | 6 |
| c. Water and miscellaneous | 4 |
| | 67 |
| d. Sodium aluminosilicate (anh.) | 12 |
| e. Water (bound to aluminosilicate) | 3 |
| f. Sodium carbonate | 15 |
| | 100 |

A structured paste was prepared by mixing a high active sodium alkyl sulphate paste (the paste comprising 20% by weight of water and not more than 4% by weight of impurities, typically sulphate and unreacted alcohol), with a 40% aqueous solution of Merquat®. The mixing was carried out in a Discotherm® and a vacuum of 40–100 mbar was applied for 1 hour to reduce the paste moisture level to 5%. The structured paste was removed from the Discotherm® at a temperature of 70° C.

A sample of the paste was then granulated in lab scale high shear mixer with a dry blend of zeolite and carbonate as in example 1.

Example 4

| Structured Paste: | Parts by weight: |
|---|---|
| a. Sodium Alkyl Sulphate | 50 |
| b1. Polyquaternium-6 | 5 |
| b2. Co-polymer of maleic & acrylic acid | 10 |
| c. Water and miscellaneous | 10 |
| | 75 |
| d. Sodium aluminosilicate (anh.) | 10 |
| e. Water (bound to aluminosilicate) | 2.5 |
| f. Sodium carbonate | 12.5 |
| | 100 |

A structured paste was prepared by mixing a high acive sodium alkyl sulphate paste (the paste comprising 20% by weight of water and not more than 4% by weight of impurities, typically sulphate and unreacted alcohol), with a 40% aqueous solution of Merquat® and a 25% aqueous solution of the copolymer. The mixing was carried out in a Discotherm® and a vacuum of 40–100 mbar was applied for 1 hour to reduce the paste moisture level to 10%. The structured paste was removed from the Discotherm® at a temperature of 70° C.

A sample of the paste was then granulated in lab scale high shear mixer with a dry blend of zeolite and carbonate as in example 1.

We claim:

1. A surfactant paste comprising, by weight:

from 50% to 95% anionic surfactant;

from 0% to 50% nonionic surfactant;

from 1% to 12% of a structuring agent selected from the group consisting of:

a. amino acids selected from the group consisting of lysine di-hydrochloride, L-arginine hydrochloride and mixtures thereof;

b. polymers having from 10 to 1,000,000 cationic functional groups per polymer, wherein the cationic functional groups are selected from the group consisting of carboxylate, amide, pyrrolidone, imidazole, imidazolinium and mixtures thereof; and c. mixtures thereof; and from 3% to 30% water;

wherein the surfactant paste has a viscosity of at least 10 Pa.s at 70° C. and 25 $sec^{-1}$.

2. A surfactant paste according to claim 1, wherein the structuring agent is a polymer having a molecular weight of from 5,000 to 100,000,000, and comprising a moiety with the structure:

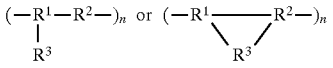

wherein n is from 100 to 10,000;

$R^1$ is an aliphatic, aromatic or saccharide group;

$R^2$ is an ester, ketone, amine or a C—C group;

$R^3$ is a carboxylate, amide, pyrrolidone, imidazole or imidazolinium; and wherein $R^3$ is connected to the backbone of the polymer by a $C_{1-10}$ alkyl or alkylene chain.

3. A surfactant paste according to claim 1, wherein the structuring agent is an amino acid having a molecular weight of from 5,000 to 100,000,000.

4. A surfactant paste according to claim 1, wherein the paste has a viscosity of from about 30 to about 70 Pa.s at 70° C. and 25 $sec^{-1}$.

5. A surfactant paste according to claim 1, comprising less than 5%, by weight, linear alkyl benzene sulfonate.

6. A surfactant paste according to claim 1, comprising, by weight:

from 50% to 95% anionic surfactant comprising a $C_{8-18}$ alkyl sulfate and less than 2%, by weight of the paste, linear alkyl benzene sulfonate;

from 1% to 12% of a structuring agent selected from the group consisting of polyquaternium-6, polyquaternium-28 and mixtures thereof; and from 5% to 20% water;

wherein the viscosity of the paste is from about 20 to about 100 Pa.s at 70° C. and 25 $sec^{-1}$.

7. A surfactant paste according to claim 1, wherein the anionic surfactant is selected from the group consisting of:

a. water-soluble salts of $C_{8-24}$ fatty acids;

b. sodium and potassium alkyl sulfates;

c. sodium and potassium alkyl benzene sulfonates;

d. sodium alkyl glyceryl ether sulfonates;

e. sodium coconut oil fatty acid monoglyceride sulfonates;

f. sodium and potassium salts of alkyl phenol ethylene oxide ether sulfates;

g. sodium and potassium salts of alkyl ethylene oxide ether sulfates;

h. alkyl ether sulfates containing from about 10 to 20 carbon atoms in the alkyl group and from about 1 to 30 moles of ethylene oxide; and i. mixtures thereof; and wherein the nonionic surfactant is selected from the group consisting of:

j. polyethylene oxide condensates of alkyl phenols;

k. water-soluble condensation products of aliphatic alcohols containing from 8 to 22 carbon atoms with from 4 to 25 moles of ethylene oxide per mole alcohol;

l. water-soluble amine oxides containing one alkyl moiety having from about 10 to 18 carbon atoms and 2 moieties each individually selected from the group consisting of alkyl groups containing from 1 to 3 carbon atoms and hydroxyalkyl groups containing from 1 to 3 carbon atoms;

m. water-soluble phosphine oxides containing one alkyl moiety having about 10 to 18 carbon atoms and 2 moieties each individually selected from the group consisting of alkyl groups containing from 1 to 3 carbon atoms and hydroxyalkyl groups containing from 1 to 3 carbon atoms;

n. water-soluble sulfoxides containing one alkyl moiety having about 10 to 18 carbon atoms and a moiety selected from the group consisting of alkyl groups containing from 1 to 3 carbon atoms and hydroxyalkyl groups containing from 1 to 3 carbon atoms; and o. mixtures thereof.

8. A method of structuring a surfactant paste comprising, by weight, from 30% to 95% anionic surfactant, from 0% to 50% nonionic surfactant and from 1% to 40% water, comprising the step of adding to the surfactant paste from 0.5% to 20%, by weight, of a structuring agent selected from the group consisting of:

a. amino acids selected from the group consisting of lysine di-hydrochloride, L-arginine hydrochloride, and mixtures thereof;

b. polymers having from 10 to 1,000,000 cationic functional groups per polymer, wherein the cationic functional groups are selected from the group consisting of carboxylate, amide, pyrrolidone, imidazole, imidazolinium and mixtures thereof; and c. mixtures thereof; and wherein after structuring the surfactant paste has a viscosity of at least 10 Pa.s at 70° C. and 25 $sec^{-1}$.

9. A method according to claim 8, wherein the surfactant paste comprises from 50% to 95%, by weight, anionic surfactant.

10. A method according to claim 8, wherein after the step of adding the structuring agent to the paste, the paste hardness increases at least 50% and the paste stickiness decreases at least 20%.

11. A method according to claim 10, wherein after the step of adding the structuring agent to the paste, the paste hardness increases at least 200% and the paste stickiness decreases at least 60%, and wherein the viscosity of the paste is from about 30 to about 70 Pa.s at 70° C. and 25 $sec^{-1}$.

12. A method according to claim 9, wherein after the step of adding the structuring agent to the paste, the paste has a viscosity of from about 20 to about 100 Pa.s at 70° C. and 25 $sec^{-1}$ and comprises, by weight:

from 50% to 95% anionic surfactant comprising a $C_{8-18}$, alkyl sulfate and less than 2%, by weight of the paste, linear alkyl benzene sulfonate;

from 1% to 12% of a structuring agent selected from the group consisting of polyquaternium-6, polyquaternium-28 and mixtures thereof; and from 5% to 20% water.

13. A method of forming a detergent agglomerate comprising the steps of:

i. forming a structured paste comprising, by weight, from 50% to 95% anionic surfactant, 1% to 40% water, and from 0.5% to 20% of a structuring agent selected from the group consisting of:

a. amino acids selected from the group consisting of lysine di-hydrochloride, L-arginine hydrochloride and mixtures thereof;

b. polymers having from 10 to 1,000,000 cationic functional groups per polymer, wherein the cationic functional groups are selected from the group consisting of carboxylate, amide, pyrrolidone, imidazole, imidazolinium and mixtures thereof; and c. mixtures thereof; and ii. granulating the paste to form an agglomerate;

wherein the operating temperature during the step of forming the structured paste is between 40° C. and 90° C., and wherein the activity of the agglomerate is at least 50%, by weight.

14. A method according to claim 13, wherein the paste has a viscosity of from about 30 to about 70 Pa.s at 70° C. and 25 $sec^{-1}$.

15. A method according to claim 13, wherein the paste comprises, by weight:

from 50% to 95% anionic surfactant;

from 0% to 50% nonionic surfactant;

from 1% to 12% structuring agent; and from 3% to 30% water.

16. A method according to claim 15, wherein the structuring agent is selected from the group consisting of polyquaternium-6, polyquaternium-28 and mixtures thereof.

17. A method according to claim 15, wherein the structuring agent is an amino acid having a molecular weight of from 5,000 to 100,000,000.

18. A method according to claim 13, wherein the step of granulating the paste comprises mixing the paste with dry builder comprising zeolite and carbonate.

19. A method according to claim 18, wherein the weight ratio of surfactant to dry builder is in the range of from 1:1 to 10:1.

20. A method according to claim 13, wherein the anionic surfactant comprises a $C_{8-18}$ alkyl sulfate and less than 2%, by weight of the paste, linear alkyl benzene sulfonate.

* * * * *